United States Patent [19]

Reid

[11] 4,319,213

[45] Mar. 9, 1982

[54] ELECTRIC FUSE FOR COMPENSATING HEATING IN THE CENTER OF THE FUSIBLE ELEMENT

[76] Inventor: Clyde D. Reid, Rte. 1-Box 221, Amesbury, Mass. 01913

[21] Appl. No.: 214,080

[22] Filed: Dec. 8, 1980

[51] Int. Cl.[3] ..... H01H 85/04; H01H 85/12

[52] U.S. Cl. ..... 337/161; 337/159; 337/279

[58] Field of Search ..... 337/161, 158, 159, 160, 337/163, 164, 165, 166, 273, 279, 281, 292, 293, 278

[56] References Cited

U.S. PATENT DOCUMENTS 3,935,553 1/1976 Kozacka et al. ..... 337/159

4,167,723 9/1979 Wilks ..... 337/161

*Primary Examiner*—Harold Broome

*Attorney, Agent, or Firm*—Erwin Salzer

[57] ABSTRACT

An electric fuse, in particular an electric time-lag fuse, comprising a tubular casing, a pair of terminal elements, a granular arc-quenching filler, and a pair of parallel fusible elements inside the casing interconnecting the pair of terminal elements. Each of the pair of fusible elements has a plurality of juxtaposed points of reduced cross-section. Juxtaposed points of reduced cross-section support an M-effect causing overlay thereon. Each of the M-effect causing overlays extends from a pair of juxtaposed points of reduced cross-section in opposite directions longitudinally of said pair of fusible elements. A substantially E-shaped member of a solid gas-evolving material having three arms is associated with said pair of fusible elements. One of said three arms is interposed between said pair of fusible elements at the region thereof where the juxtaposed points of reduced cross-section are located. One of each of the two remaining arms of the substantially E-shaped member is arranged close to said parallel fusible elements and extends at right angles to edges formed by them. The aforementioned three arms are tied together by a fourth arm, at right angles to the aforementioned three arms, so that a substantially E-shaped solid is formed.

5 Claims, 3 Drawing Figures

ELECTRIC FUSE FOR COMPENSATING HEATING IN THE CENTER OF THE FUSIBLE ELEMENT

BACKGROUND OF THE INVENTION

This invention is based on the well-known theory of arc extinction by arc elongation. Since this theory has received little attention in the context of this invention, the relevant points of the theory of arc extinction by arc elongation will be briefly restated below.

Assume a linear fusible element of any metal, such as, e.g., silver or copper, is or is not embedded in an arc-quenching filler, such as quartz sand. Let the center of that fusible element be designated by the reference numeral 0, and points spaced equal distances to the left or the right from the center 0 be designated by the reference characters 1, 2, 3, 4, 5. This then yields the array of numerals indicated below:

5 4 3 2 1 0 1 2 3 4 5.

On low overloads the temperature distribution along this array is substantially parabolic, with a peak temperature at the center point 0, and negative gradients from 0 to both ends 5. Consequently melting and arc initiation occurs at the point 0 and a high initial arc voltage is developed at that point. That arc voltage is, however, far less than the arc voltage required to significantly decrease the current flow in the fusible element. As the fusible element burns back from 0 to 101, the arc voltage undergoes two changes. It is increased, on the one hand, by the elongation of the arc, and it is decreased, on the other hand, by the continued arcing time and the continued heat generation at the point 0 and the points immediately adjacent thereto. This may be expressed by the equation $$V = V_{1-1} - V_o.$$

Where V is the driving voltage, where $V_{1-1}$ is the gain in voltage drop due to an elongation from 0 to 1-0-1 and where $V_o$ is the loss in voltage drop due to continued or prolonged heat generation and thermal ionization in the time required for the arc to reach the length 1-0-1. This continuous process of increase of arc voltage due to arc elongation and decrease of arc voltage due to prolonged heat generation and thermal ionization continues until the first and second term in the above equation are equal, and the driving voltage is consequently zero.

It is apparent from the above that the most effective means for extinguishing low current arcs must generally act on the center portion of the arc where the decrease of arc voltage with time is highest.

This invention relates to a particularly simple and cost-effective means for deionizing and cooling the center portion of an electric arc in a fuse, or other points thereof where arc-initiation occurs at load currents.

REFERENCE TO PRIOR ART

The closest prior art known to me is U.S. Pat. No. 3,935,553 to F. J. Kozacka et al; Jan. 27, 1976 for CARTRIDGE FUSE FOR D-C CIRCUITS; U.S. Pat. No. 4,167,723 to H. G. Wilks; Sept. 11, 1979 for ELECTRIC FUSE HAVING GAS-EVOLVING MATERIAL and U.S. Pat. No. 4,216,457 to R. J. Panaro; Aug. 5, 1980 for ELECTRIC FUSE HAVING FOLDED FUSIBLE ELEMENT AND HEAT DAMS.

SUMMARY OF THE INVENTION

The invention refers to an electric fuse comprising a tubular casing of electric insulating material, such as a laminate of glass-cloth-melamine or glass-cloth-polyester and terminal elements close the ends of the casing. These terminal elements may be either terminal caps, or terminal plugs, the former mounted on the casing at the ends thereof, and the latter plugged into the ends of the casing. The casing is filled with a granular arc-quenching material, e.g. quartz sand. A pair of fusible elements is arranged inside said casing, embedded in said arc-quenching filler and conductively interconnects said pair of terminal elements. Each of said pair of fusible elements has edges extending in a direction longitudinally thereof, and each of said fusible elements has a plurality of points of juxtaposed reduced cross-section arranged at the same level. Each of said pair of fusible elements further supports an M-effect causing overlay.

If the fuse is supposed to have time-lag, the fusible elements are channel shaped, including a web portion and two flange portions projecting from said web portion at acute angles. One of a pair of M-effect causing overlays begins at juxtaposed points of reduced cross-section and extends in opposite direction longitudinally of said pair of fusible elements. It will be understood that these overlays are provided to juxtaposed sides of said pair of fusible elements. They begin on juxtaposed points of reduced cross-section and extend in opposite directions away from said points in a direction longitudinally of said fusible element.

An E-shaped member of a solid gas-evolving material is arranged in the regions of juxtaposed points of reduced cross-section of each of said pair of fusible elements. Said E-shaped member defines a plane substantially at right angles to said pair of fusible elements and is provided with three arms. One of said arms is interposed between said pair of fusible elements at the region thereof where said pair of M-effect causing overlays are located, and one of the two remaining arms of said substantially E-shaped member is arranged in close proximity to said pair of fusible elements and extends to the edges thereof. If time-delay is required, the two fusible elements are channel-shaped, each including a web portion on two flange portions. The web portions are in engagement with the center arm and the flange portions are bounded by the outer arms.

DESCRIPTION OF PREFERRED EMBODIMENT

Figure 1:
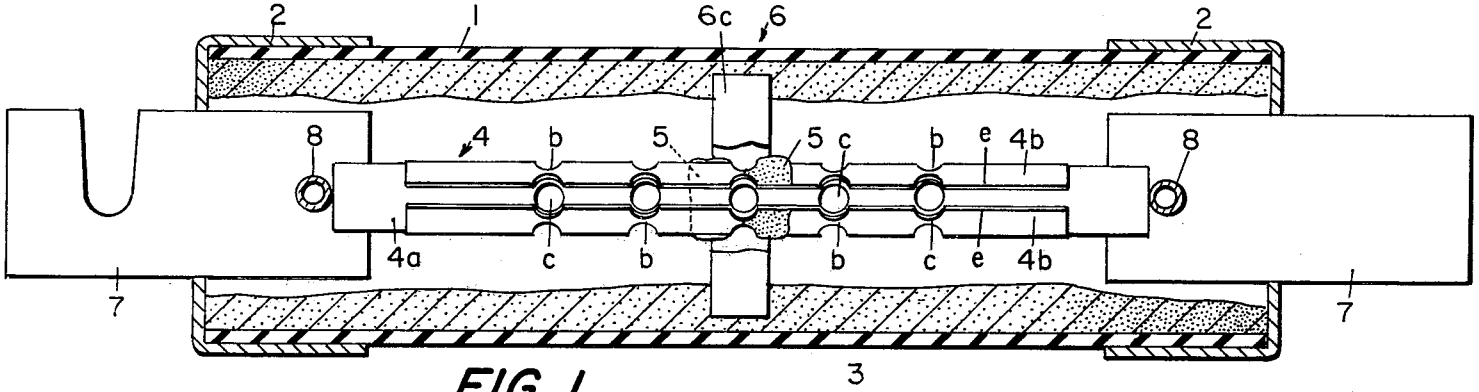
FIG. 1 is a longitudinal section of a fuse embodying this invention, showing some parts in front view rather than in section.
Figure 2:
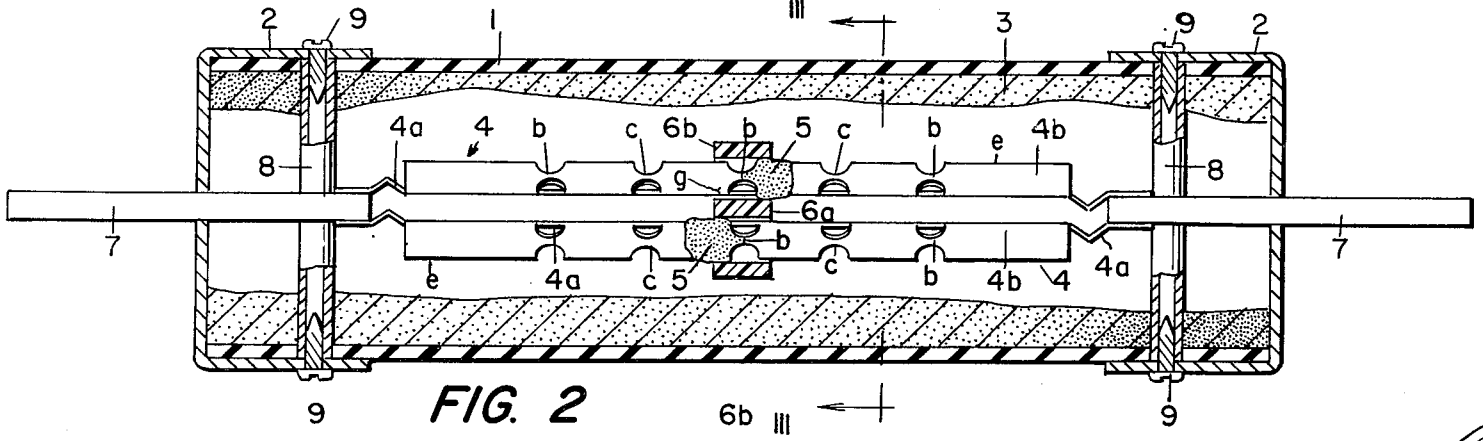
FIG. 2 is a section taken at right angles to the plane of FIG. 1, showing some parts in front view rather than in section.
Figure 3:
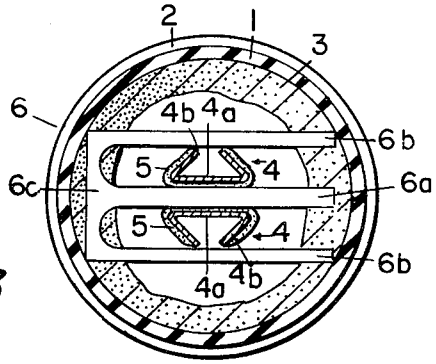
FIG. 3 is a section along III—III of FIG. 2.

In the drawings reference numeral 1 has been applied to indicate a tubular casing of an electric insulating material which is closed at the ends thereof by terminal elements 2 in the form of ferrules, or terminal caps 2. A granular arc-quenching filler 3 is arranged inside of casing 1. A pair of linear fusible elements 4 is embedded in arc-quenching filler 3 and conductively interconnects terminal caps or ferrules 2. Where it is not desired to achieve time-lag, each fusible element may be simply of the ribbon type. Where time-lag is intended to be achieved, the fusible elements 4 are preferably channel-shaped, as shown in the drawings, including web portions 4*a* and flange portions 4*b*. The web portions 4*a* and the flange portions 4*b* enclose acute angles which result in a mutual heating of the web portions and flange portions by juxtaposed points of reduced cross-section b formed, e.g., by circular perforations c in the web portions 4*a* and in the flange portions 4*b*. The point of reduced cross-section b in the center of the fuse links 4 is the point of arc initiation, if the M-effect causing metal overlays 5 are located to both sides of these points of reduced cross-section b in the center of the fusible elements 4 where the temperature is highest. In certain instances the overlays 5 may, however, be arranged off-center on juxtaposed or corresponding points of reduced cross-section where the temperature in both fusible elements is equal. The M-effect causing fusible overlays 5 preferably surround the outer periphery of each fusible element 4, as clearly shown in FIG. 3, i.e., they extend over the parallel juxtaposed sides of web portions 4*a* and over the flange portions 4*b* and projecting from web portions 4*a*. As shown in FIGS. 1 and 2 overlays 5 extend from the center point b in each fusible element 4 in an opposite direction, i.e., one overlay 5 extends to the left and the other overlay 5 extends to the right of juxtaposed points b of fusible elements 4. Reference character 6 has been applied to indicate a substantially E-shaped member of a solid gas-evolving material, i.e., a material that evolves an arc-extinguishing gas under the action of an electric arc. Gas-evolving member 6 is normally arranged in the center region of the pair of channel-shaped fusible elements, and comprises three transverse arms of which the reference character 6*a* has been applied to indicate the center or inner arm, and reference character 6*b* has been applied to indicate the two outer arms. Arms 6*b*, 6*a*, 6*b* are tied together by a tie arm 6*c* so that the arms 6*b*, 6*a*, 6*b* and 6*c* form a self-sustained unitary structure. Arm 6*a* is inserted in the gap g formed between the web portions 4*a* of fusible elements 4 separating web portions 4*a* from each other. Each of the transverse arms 4*b* is arranged immediately adjacent the edges e formed by flange portions 4*b* of channel-shaped fusible elements 4. The web portions 4*a* of fusible elements 4 are conductively connected to a pair of blade contacts 7 which project through the end surfaces of caps or ferrules 2. Blade contacts 7 are further supported by hollow pins 8 whose outer ends are expanded by nails 9 projecting through ferrules 2 and casing 1. The web portions 4*a* of the fusible elements are provided with bends at the ends thereof (to which no reference numeral has been applied) to increase the flexibility of the fusible elements 4.

Regarding the operation of the above described structure, the spacing of M-effect overlays 5 on the two web portions 4*a* and the two flange portions 4*b* thereof from the point of reduced cross-section b diffuses the metal gases resulting when the M-effect takes place because the M-effect metal, e.g., tin and its vapors as well as the vapors of the fusible element 4 are spread over a relatively wide area in comparison to prior art M-effect devices. The gases evolved adjacent the point of their generation tend to flow in opposite directions from the points where they are generated. Whatever the particular effects of the location of overlays 5 and the gas-evolving structure 6, the cooling of the center region of the fusible element is much more effective than in comparable prior art devices and, therefore, the time of burnback of the fusible elements 4 is reduced and so is the arc energy from the time of arc inception to the time of arc extinction.

Some of the advantages of the present invention will become apparent when considering the physics involved in the cooling process:

(1) It is known that quartz sand fuses into a fulgurite, when subjected to arcing temperatures, which inhibits the radial outflow of heat. This limitation is avoided in the structure according to this invention.

(2) It is also known that the use of a granular gas-evolving material imposes a smaller limitation on radially outward heat flow than quartz sand. However, such a construction is far less cost-effective than the present invention because it calls generally for an additional filler capable of quenching short-circuit arcs, or arcs involving high currents, and it further requires means for separating the two arc-quenching fillers.

(3) M-effect is a conversion of a base metal -silver or copper- into alloys of the base metal and the overlay metal, such as tin. These alloys have a higher resistivity and result in a higher heat generation than the unalloyed base metal. This conversion is spread in fuses according to this invention over a wider area than in comparable prior art fuses, because heat flow is proportional to the area of the surface across which the heat flow takes place.

The manufacture of the gas-evolving solid with its four arms 6*b*, 6*a*, 6*b* and 6*c*, and its gaps of equal width for fusible elements 4 requires special equipment, not normally found in a fuse manufacturing plant. But this is not a serious limitation because such equipment is relatively inexpensive and cost-effective.

I claim as my invention:

1. An electric fuse comprising a tubular casing of electric insulating material, terminal elements closing said casing at the ends thereof, a granular arc-quenching filler inside said casing, a pair of fusible elements having edges extending in a direction longitudinally thereof embedded in said arc-quenching filler and conductively interconnecting said pair of terminal elements, each of said pair of fusible elements having juxtaposed points of reduced cross-section, and each of said pair of fusible elements further supporting an M-effect - causing overlay on one of said juxtaposed points of reduced cross-section wherein (a) said M-effect causing overlay on each of a juxtaposed point of reduced cross-section extends in opposite directions away from said points in a direction longitudinally of said pair of fusible elements;

(b) a substantially E-shaped member of solid gas-evolving material has three parallel spaced arms, said arms define a plane substantially at right angles to said pair of fusible elements;

(c) one of said pair of arms is interposed between said pair of fusible elements at the region thereof where two of said juxtaposed points of reduced cross-section are located;

(d) one of each of the two other arms of said substantially E-shaped member is arranged in close proximity to said pair of fusible elements at right angles to said edges thereof; and (e) a tie arm is arranged at right angles to said three arms integrating said three arms into a unitary structure.

2. A fusible element as specified in claim 1 wherein points of said E-shaped member extend to and physically engage said casing so that said M-shaped member is supported by said casing and does not need any additional support.

3. An electric fuse comprising a tubular casing of electric insulating material, terminal elements closing said casing, a granular arc-quenching filler inside said casing, a pair of fusible elements embedded in said arc-quenching filler conductively interconnecting said pair of terminal elements, said pair of fusible elements being substantially in the shape of channels having web portions spaced by a gap and two flange portions projecting at acute angles from said web portions, said web portions and said flange portions being perforated in such a way that they form juxtaposed points of reduced cross-section, and each of said pair of fusible elements further supporting at juxtaposed points of reduced cross-section an M-effect causing overlay wherein (a) said M-effect-causing overlay extends from two juxtaposed points of reduced cross-section of said web portions and said flange portions of each of said pair of fusible elements in opposite directions longitudinally of said pair of fusible elements covering a fraction of said web portion and said flange portions of each of said pair of fusible elements;

(b) a substantially E-shaped member of solid gas-evolving material having three parallel spaced arms defines a plane substantially at right angles to said web portions of said pair of fusible elements;

(c) one of said arms projects into said gap formed between said web portions at the region thereof where two of said juxtaposed points of reduced cross-section are located;

(d) one of each of the two other arms cross at right angles the outer edges of said flange portions; and (e) a tie arm arranged substantially at right angles to the plane defined by said three arms integrates said three arms into a unitary structure.

4. An electric fuse comprising a tubular casing of electric insulating material, terminal elements closing said casing, a granular arc-quenching filler inside said casing, a pair of fusible elements embedded in said arc-quenching filler conductively interconnecting said pair of terminal elements, said pair of fusible elements being substantially in the shape of channels having web portions spaced by a gap and two flange portions projecting at acute angles from said web portions, said web portions and said flange portions being perforated in such a way that they form juxtaposed points of reduced cross-section, and each of said pair of fusible elements further supporting at juxtaposed points of reduced cross-section an M-effect-causing overlay wherein (a) said M-effect-causing overlay extends on each of said fusible elements from juxtaposed points of reduced cross-section of said web portions and said flange portions in opposite directions and covers the outer periphery of said web portion and the outer periphery of said flange portions of each of said pair of fusible elements;

(b) a substantially E-shaped member of solid gas-evolving material has three parallel spaced arms defining a plane substantially at right angles to said web portions of said pair of fusible elements, said substantially E-shaped member includes an inner arm and two outer arms;

(c) said web portions of said pair of fusible elements are arranged in abutting relation with said inner arm of said substantially E-shaped member;

(d) said flange portions of said pair of fusible elements are arranged in the spaces between said inner arm and said outer arms of said substantially E-shaped member; and (e) a tie arm arranged at substantially right angles to said three arms integrates said three arms into a unitary structure.

5. An arc-suppressing device for fuses having two parallel fusible elements comprising (a) a body of solid gas-evolving material having a center arm and two outer arms, all of said arms being parallel and arranged in a common plane and defining a first gap between one of said outer arms and said center arm and defining a second gap between the other of said outer arms and said center arm;

(b) said first gap and said second gap being of equal width; and (c) an additional arm arranged substantially at right angles to said center arm and said two outer arms and forming a unitary solid of said center arm, said two outer arms and said additional arm.

* * * * *